US009855457B2

(12) United States Patent
Wang

(10) Patent No.: US 9,855,457 B2
(45) Date of Patent: Jan. 2, 2018

(54) PULL-UP FITNESS EXERCISE MACHINE

(71) Applicant: Leao Wang, Taichung (TW)

(72) Inventor: Leao Wang, Taichung (TW)

( * ) Notice: Subject to any disclaimer, the term of this patent is extended or adjusted under 35 U.S.C. 154(b) by 187 days.

(21) Appl. No.: 14/987,788

(22) Filed: Jan. 5, 2016

(65) Prior Publication Data

US 2017/0189734 A1 Jul. 6, 2017

(51) Int. Cl.
*A63B 21/00* (2006.01)
*A63B 21/068* (2006.01)

(52) U.S. Cl.
CPC ..... *A63B 21/068* (2013.01); *A63B 21/00185* (2013.01); *A63B 21/151* (2013.01); *A63B 21/154* (2013.01); *A63B 21/4035* (2015.10)

(58) Field of Classification Search
CPC ..... A63B 21/00
USPC ..... 482/96, 100, 142
See application file for complete search history.

(56) References Cited

U.S. PATENT DOCUMENTS 3,128,094 A * 4/1964 Wolf ..... A63B 1/00 482/113
5,312,313 A * 5/1994 Holmes ..... A63B 21/00181 482/51
5,322,489 A * 6/1994 Webb ..... A63B 21/00181 482/100
5,554,083 A * 9/1996 Chen ..... A63B 21/00181 482/138
7,789,812 B2 * 9/2010 Anderson ..... A63B 7/04 482/95
8,152,700 B2 * 4/2012 Adams ..... A63B 21/154 482/94
9,415,293 B1 * 8/2016 Wang ..... A63B 21/00072
2007/0232464 A1 * 10/2007 Chu ..... A63B 21/00072 482/96
2013/0102443 A1 * 4/2013 Lundquist ..... A63B 21/068 482/93
2015/0217156 A1 * 8/2015 Meredith ..... A63B 21/062 482/38

* cited by examiner

*Primary Examiner* — Stephen R Crow
(74) *Attorney, Agent, or Firm* — Jackson IPG PLLC; Demian K. Jackson

(57) ABSTRACT

A pull-up fitness exercise machine includes a base, a cantilever, a cantilever aligning unit, a pulling and latching unit, an assisted pushing unit, a limit assembly and a support plate. At a low static position, the support plate is acted by the limit assembly and fixed to a bottom position of the base, such that only after a specific gravitational force is exerted onto the support plate, and the cantilever is pulled downward, the support plate is released from a locked status. In addition, a central column at the bottom of the base has an inverted hook member operating together with a circular ring installed at a corresponding position of the support plate to form a secondary safety device to prevent the support plate to have any unexpected lifting movement and ensure the safety of use.

3 Claims, 8 Drawing Sheets

PULL-UP FITNESS EXERCISE MACHINE

BACKGROUND OF THE INVENTION

1. Field of the Invention

The present invention relates to an improved structure of a pull-up fitness exercise machine, and more particularly to a pull-up fitness exercise machine providing a reliable and stable operation to reduce the failure rate and assure safety of use.

2. Description of the Related Art

As disclosed in U.S. patent application Ser. No. 14/622,932 entitled "Pull-up fitness exercise machine" and filed by the inventor of the present invention, an innovative product having a support plate situated at a low static position was disclosed, such that a user may step on the support plate or step down from the support plate easily to carry out the expected exercise. The technical characteristics of related mechanism and design have been disclosed clearly in the specification of the Ser. No. 14/622,932 application, and thus will not be repeated. The present invention further improves the Ser. No. 14/622,932 application, since the Ser. No. 14/622,932 application uses a linking rope to release the latched status of the support plate, but the linking rope may be broken after being used for a period of time, and this may jeopardize the user's safety. Therefore, it is necessary to prevent such accident and improve the conventional pull-up fitness exercise machine.

In addition, the Ser. No. 14/622,932 application only uses the linking rope and the linking hook lever to lock the support plate to a low static position. If any component fails, the user's safety will be jeopardized as well, and the intended technical characteristics of the conventional pull-up fitness exercise machine would become ineffective and useless.

SUMMARY OF THE INVENTION

Therefore, it is a primary objective of the present invention to provide a pull-up fitness exercise machine that replaces the rope by a linking hook lever linked with a cantilever to reduce the chance of breaking the rope or causing accident. In addition, a manual hook assembly is installed between the support plate and the base to provide a secondary safety device and improve the safety of use.

According to the invention, a pull-up fitness exercise machine includes a base, a cantilever, a cantilever aligning unit, a pulling and latching unit, an assisted pushing unit, a limit assembly and a support plate. At a low static position, the support plate is acted upon by the limit assembly and fixed to a bottom position of the base, such that only after a specific force is exerted onto the support plate, and the cantilever is pulled downward, the support plate is released from a locked status. In addition, a central column at the bottom of the base has an inverted hook member operating together with a circular ring installed at a corresponding position of the support plate to form a secondary safety device to prevent the support plate to have any unexpected lifting movement and ensure the safety of use.

DETAILED DESCRIPTION OF THE PREFERRED EMBODIMENT

Figure 1:
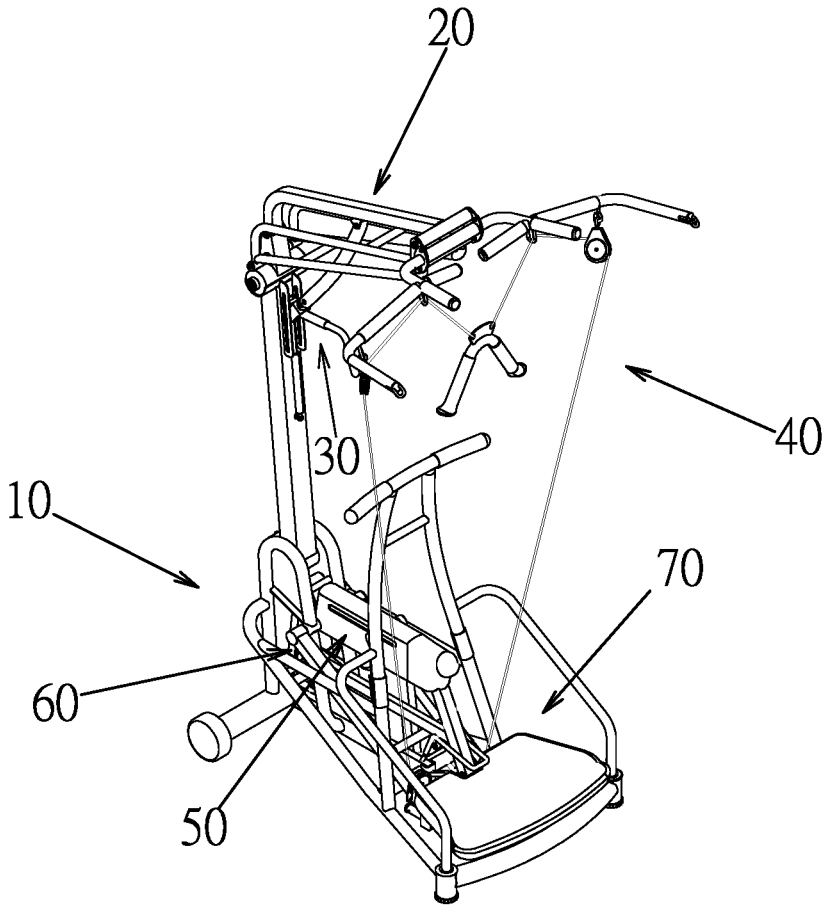
FIG. 1 is a perspective view of a pull-up fitness exercise machine in accordance with a preferred embodiment of the present invention.
Figure 2:
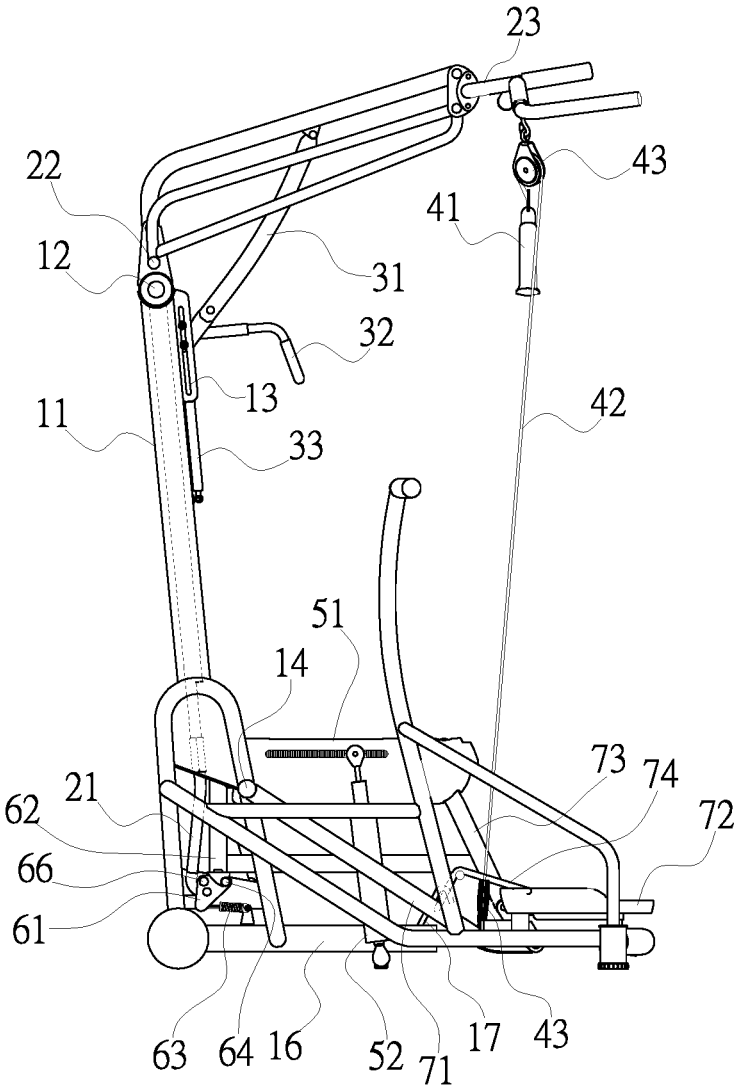
FIG. 2 is a schematic planar view of the pull-up fitness exercise machine as depicted in FIG. 1.
Figure 3:
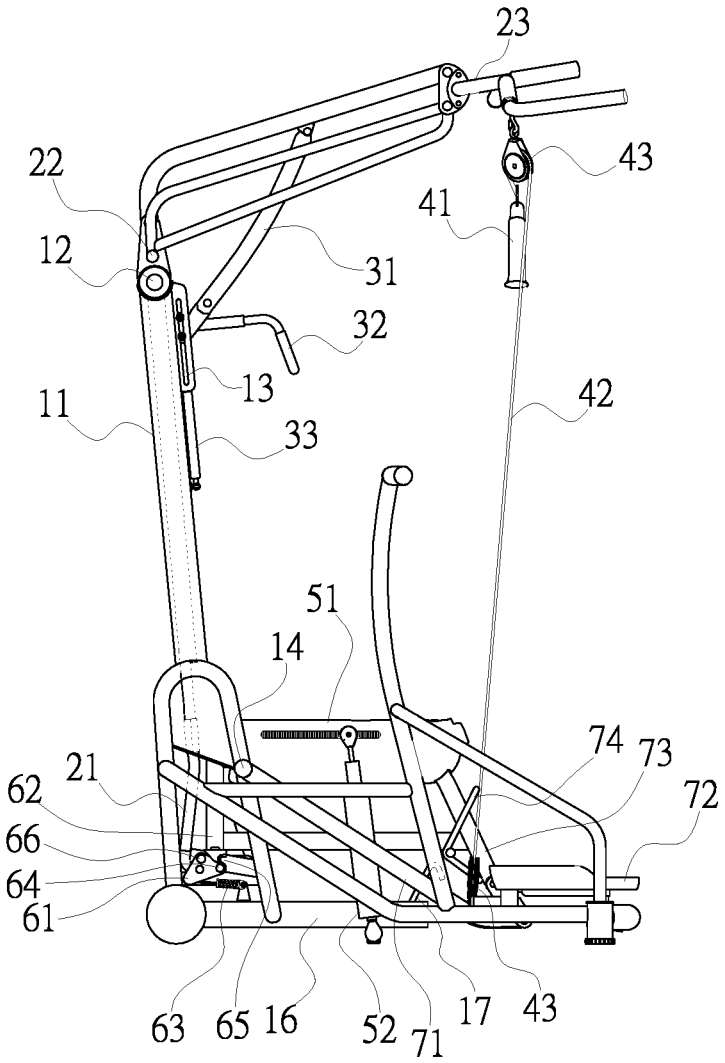
FIG. 3 is a schematic view of operating a limit assembly and releasing the hooked status of an inverted hook member in accordance with the present invention.
Figure 4:
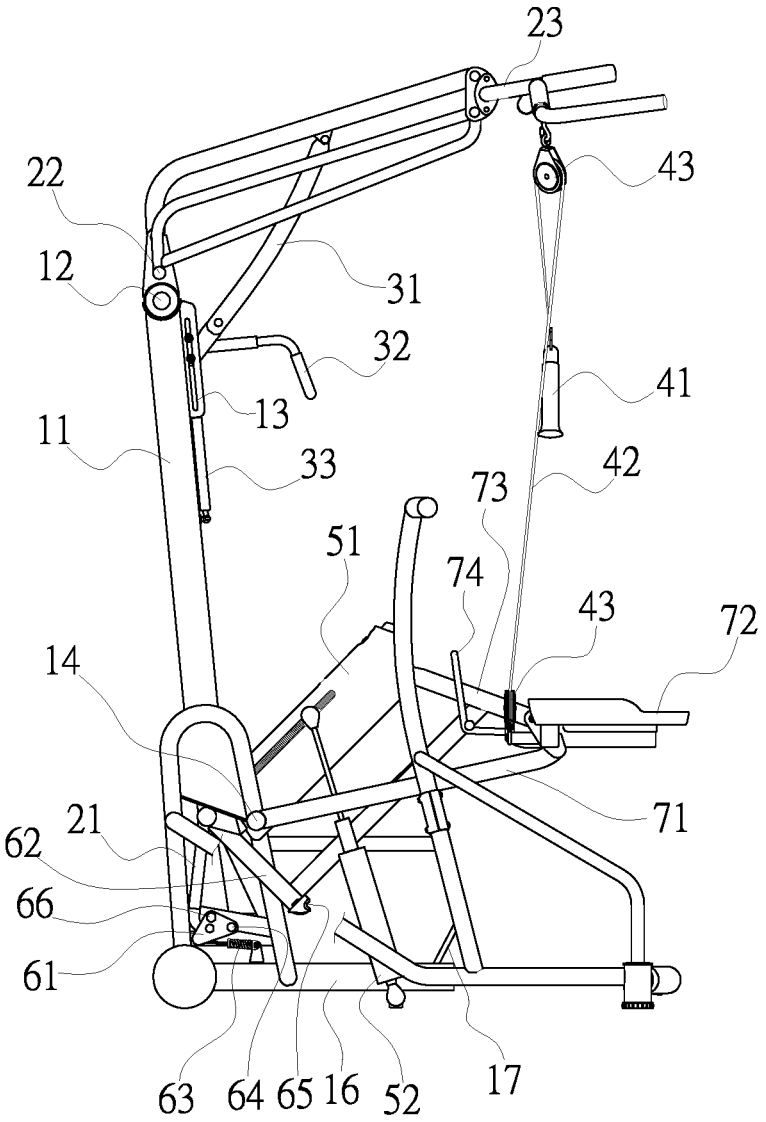
FIG. 4 is a schematic view of operating a support plate of the present invention.

The technical measures and characteristics of the present invention will become clearer in light of the following detailed description of an illustrative embodiment of this invention described in connection with the drawings.

With reference to FIGS. 1 to 4 for a pull-up fitness exercise machine of the present invention, the pull-up fitness exercise machine comprises a base 10, a cantilever 20, a cantilever aligning unit 30, a pulling and latching unit 40, an assisted pushing unit 50, a limit assembly 60, and a support plate 70.

The base 10 is attached flatly on the ground, and includes a hollow upright column 11 disposed on a side of the base 10 and provided for inserting a linking hook lever 21 at a lower end of the cantilever 20, and a first pivot 12 is provided for pivoting with the cantilever 20.

The cantilever 20 has an upper end pivotally coupled to a fork 23 by using two cantilever pivots 22 and provided for installing a pulling and latching unit 40, and a lower end of the cantilever 20 is a linking hook lever 21.

The cantilever aligning unit 30 is installed at a guide slot 13 formed on a side of the upright column 11, and includes an oblique support rod 31, a position adjusting lever 32 and a pneumatic rod 33 pivotally coupled to the cantilever 20.

The pulling and latching unit 40 is installed between the fork 23 and the support plate 70 and includes a pull handle 41, a pull string 42 and a plurality of pulleys 43, for driving the support plate 70 to displace in upper and lower strokes.

The assisted pushing unit 50 is pivotally coupled to the bottom of the base 10 and includes a resistance adjusting mechanism 51 and a spring pneumatic cylinder 52 for providing a lifting force to the support plate 70, and the lifting force is adjustable freely.

The limit assembly 60 is comprised of a hook plate 61 pivotally coupled to the bottom of the linking hook lever 21, an assisted hook lever 62 linked to the assisted pushing unit 50, and an elastic member 63 installed at the bottom of the base 10, and the hook column 64 of the hook plate 61 operated with the corresponding hook hole 65 of the assisted hook lever 62 forms a hook action, so that the support plate 70 can be positioned securely at a low static position.

The support plate 70 is pivotally coupled to the support plate 72 by using two side bars 71, and the other end of the two side bars 71 is pivotally coupled to a second pivot 14 of the base 10, and a coupling lever 73 is provided for pivotally coupling and linking the support plate 72 to the resistance adjusting mechanism 51.

When the support plate 70 is situated at a low static position, the support plate 70 is acted by the limit assembly 60 and fixed to a bottom position of the base 10, such that only after a specific gravitational force is exerted onto the support plate 70 and the cantilever 20 is pulled downward, the linking hook lever 21 displaces sideway slightly by using the first pivot 12 as a fulcrum to drive the hook plate 61 to rotate appropriately by using a swivel 66 as the fulcrum, so that the hook column 64 is separated from the corresponding hook hole 65 of the assisted hook lever 62 before the support plate 70 can be released from its locked status and used successfully by a user. After the external force is released, the elastic member 63 pulls the linking hook lever 21 and its hook plate 61 back to their original positions.

Figure 5:
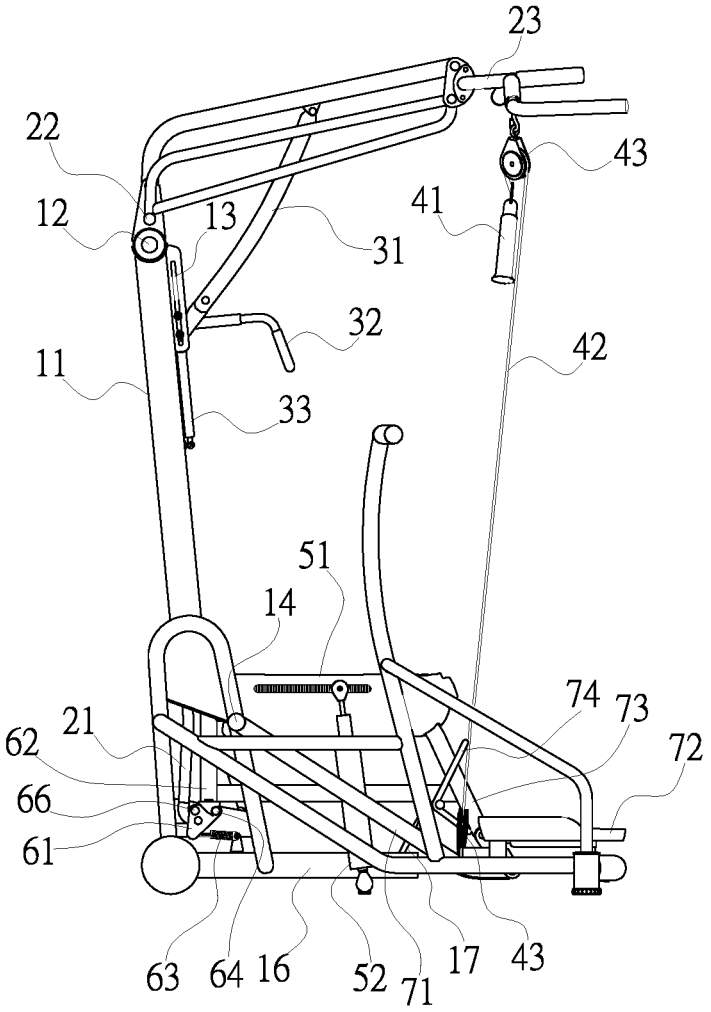
FIG. 5 is a schematic view of an adjustment made by a cantilever aligning unit of the present invention.
Figure 7:
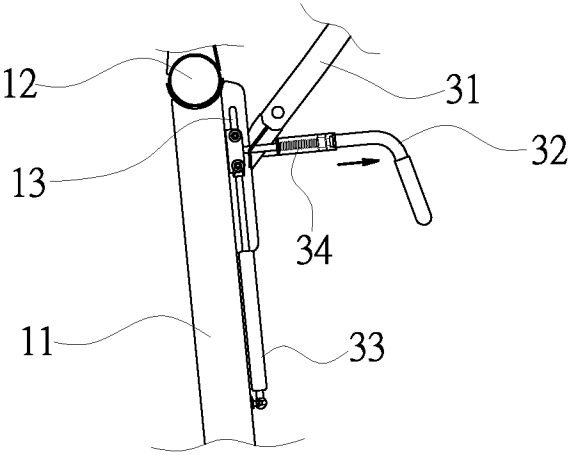
FIG. 7 is a partial schematic view of an operation of a cantilever aligning unit of the present invention.
Figure 6:
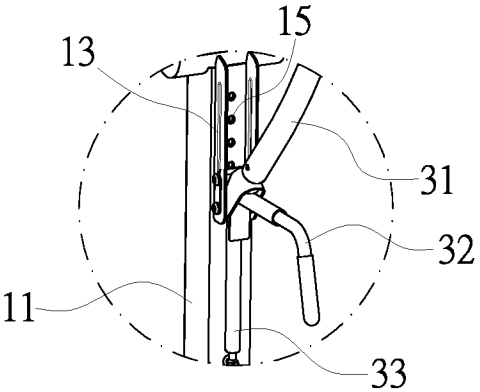
FIG. 6 is a partial perspective view of a cantilever aligning unit of the present invention.

With reference to FIGS. 5, 6, and 7 for the operation of the cantilever aligning unit 30, the position adjusting lever 32 is pulled outward and separated from the respective insert hole 15 of the upright column 11, and the force applied to the position adjusting lever 32 is released after a desired position is obtained, and the automatic restoration of a spring 34 installed in the position adjusting lever 32 drives the position adjusting lever 32 to be inserted into an expected selective insert hole 15 to complete the operation of adjusting the height of the fork 23 easily.

Figure 9:
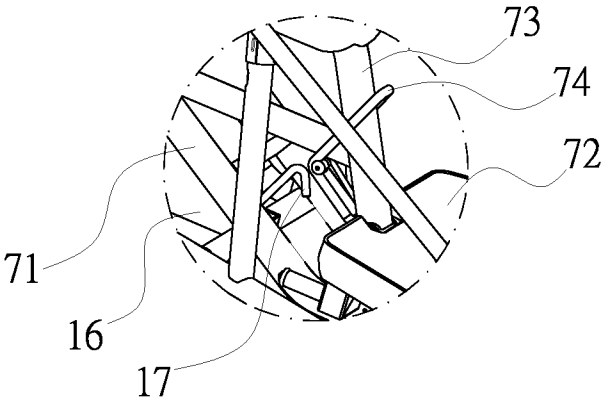
FIG. 9 is a partial perspective view of an inverted hook member in a released status in accordance with the present invention.
Figure 8:
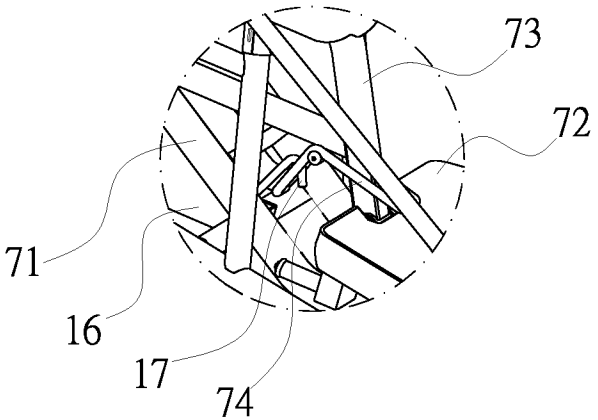
FIG. 8 is a partial perspective view of an inverted hook member in a hooked status in accordance with the present invention.

In FIGS. 8 and 9, an inverted hook member 17 is installed onto the central column 16 at the bottom of the base 10 and operated with a circular ring 74 installed at a corresponding position of the support plate 70 to form a secondary safety device, so as to prevent the support plate 70 to have any unexpected lifting movement and ensure the safety of use.

Since the control mode and basic function of the assisted pushing unit 50 are similar to those of the prior art, therefore they will not be described in details.

Figure 10:
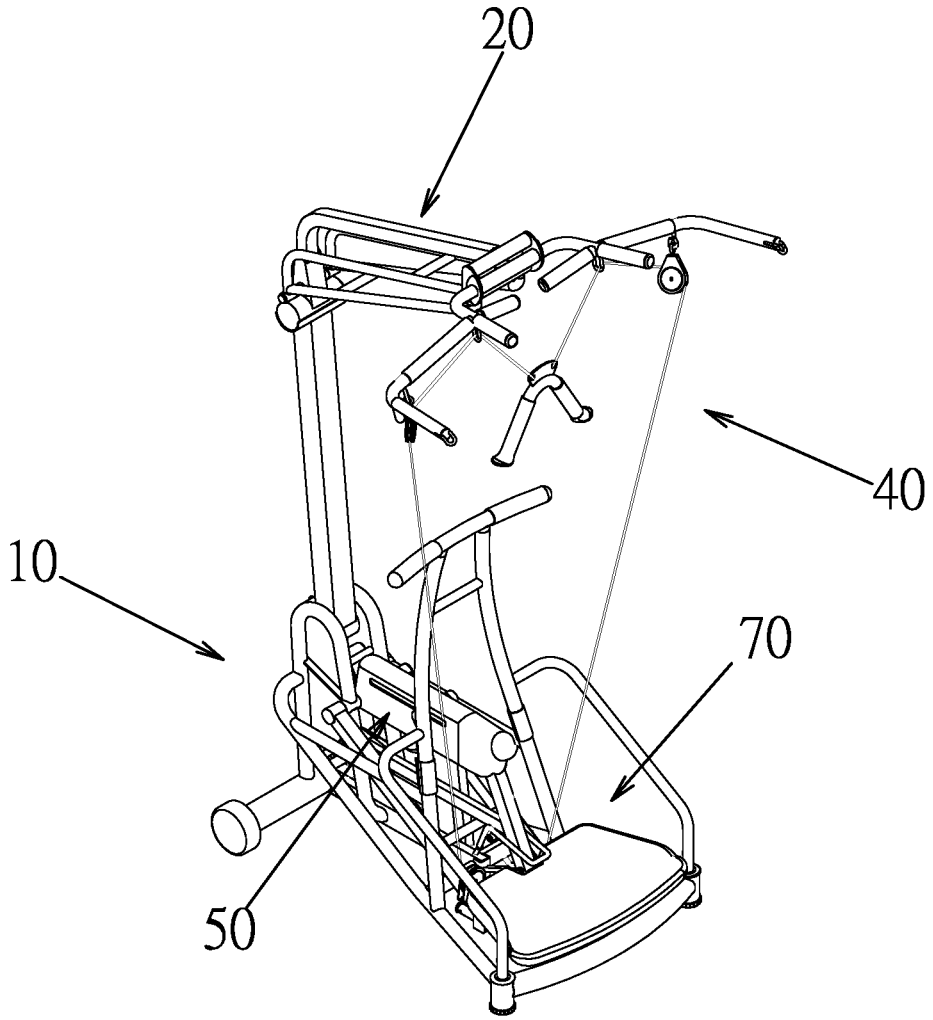
FIG. 10 is a perspective view of another preferred embodiment of the present invention.

In FIG. 10, the present invention may omit the cantilever aligning unit 30 and the limit assembly 60 and simply uses the inverted hook member 17 and the circular ring 74 to achieve the effect of fixing the support plate 70 at a low position.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A pull-up fitness exercise machine, comprising:

a base configured to be supported on a floor;

a first support plate;

a cantilever comprising a hollow upright column disposed on a side of the base, a guide slot formed on a side of the upright column, a linking hook lever connected at a lower end of the upright column, a first pivot pivotally coupled to an upper end of the upright column, and a fork pivotally coupled to the upper end of the upright column by two cantilever pivots;

a cantilever aligning unit connected at the guide slot and comprising an oblique support rod, a position adjusting lever, and a pneumatic rod pivotally coupled to the cantilever;

a pulling and latching unit connected between the fork and the support plate and including a pull handle, a pull string, and a plurality of pulleys so as to drive the support plate to displace in upper and lower strokes;

an assisted pushing unit pivotally coupled to a bottom of the base and including a resistance adjusting mechanism and a spring pneumatic cylinder so as to provide an adjustable lifting force to the support plate;

a limit assembly comprising a hook plate pivotally coupled to a bottom end of the linking hook lever and with a hook column, an assisted hook lever linked to the assisted pushing unit and defining a hook hole, and an elastic member connected at the bottom of the base, wherein the hook column performs a hook action with the assisted hook lever so that the support plate is positioned securely at a low static position;

a second support plate pivotally coupled to the first support plate by two side bars which are further pivotally coupled to a second pivot of the base; and a coupling lever being pivotally coupling and linking the second support plate to the resistance adjusting mechanism, wherein, when the first support plate is situated at the low static position, the first support plate is controlled by the limit assembly and fixed to a bottom position of the base, so that only after a specific force is exerted onto the first support plate and the cantilever is pulled downward, the linking hook lever displaces sideways so as to drive the hook plate to rotate and separate the hook column from the corresponding hook hole of the assisted hook lever in order to release the first support plate from a locked status and such that the elastic member pulls the linking hook lever and hook plate to original positions after the force is released.

2. The pull-up fitness exercise machine of claim 1, further comprising an inverted hook member connected onto a central column at the bottom of the base and a circular ring connected at a corresponding position of the first support plate engaged with the inverted hook member to form a secondary safety device inhibiting the first support plate from lifting movement.

3. A pull-up fitness exercise machine, comprising:

a base configured to be supported on a floor;

a first support plate;

a cantilever comprising a hollow upright column disposed on a side of the base, a guide slot formed on a side of the upright column, a linking hook lever connected at a lower end of the upright column, a first pivot pivotally coupled to an upper end of the upright column, and a fork pivotally coupled to the upper end of the upright column by two cantilever pivots;

a pulling and latching unit connected between the fork and the support plate and including a pull handle, a pull string, and a plurality of pulleys so as to drive the support plate to displace in upper and lower strokes;

an assisted pushing unit pivotally coupled to a bottom of the base and including a resistance adjusting mechanism and a spring pneumatic cylinder so as to provide an adjustable lifting force to the support plate;

a second support plate pivotally coupled to the first support plate by two side bars which are further pivotally coupled to a second pivot of the base;

a coupling lever being pivotally coupling and linking the second support plate to the resistance adjusting mechanism, wherein, when the first support plate is situated at the low static position, the first support plate is controlled by the limit assembly and fixed to a bottom position of the base, so that only after a specific force is exerted onto the first support plate and the cantilever is pulled downward, the linking hook lever displaces sideways so as to drive the hook plate to rotate and separate the hook column from the corresponding hook hole of the assisted hook lever in order to release the first support plate from a locked status and such that the elastic member pulls the linking hook lever and hook plate to original positions after the force is released;

an inverted hook member connected onto a central column at the bottom of the base; and a circular ring connected at a corresponding position of the first support plate engaged with the inverted hook member to form a secondary safety device inhibiting the first support plate from lifting movement.

* * * * *